US005632394A

United States Patent [19]

Mecca et al.

[11] Patent Number: 5,632,394

[45] Date of Patent: May 27, 1997

[54] CONTAINER WITH ROTATING MECHANISM FOR PRODUCING AN AUDIBLE CLOSING SOUND

[75] Inventors: Anna Mecca, Ridgefield, N.J.; John J. Slink, Greenwich, Conn.

[73] Assignee: Jerhel Plastics, Inc., Bayonne, N.J.

[21] Appl. No.: 442,410

[22] Filed: May 16, 1995

[51] Int. Cl.[6] ..... B65D 43/08

[52] U.S. Cl. ..... 220/336; 132/315; 206/37; 206/581; 206/235; 206/823; 220/291; 220/290; 220/331; 220/DIG. 26; 215/322

[58] Field of Search ..... 132/295, 315; 220/291, 290, 288, 331, DIG. 26, 336; 206/37, 235, 581, 823, 816; 215/217, 322, 335, 206, 329; 116/67 R, 205

[56] References Cited

U.S. PATENT DOCUMENTS

| | | | |
|---|---|---|---|
| D. 116,726 | 9/1939 | Schliaparelli | 220/DIG. 26 X |
| 1,460,950 | 7/1923 | Denney | 132/295 |
| 1,875,127 | 8/1932 | Parkin | 220/DIG. 26 X |
| 2,466,295 | 4/1949 | Algier | 220/291 |
| 4,454,889 | 6/1984 | Contreras, Sr. | 132/301 |
| 5,186,318 | 2/1993 | Oestreich | 206/37 |
| 5,186,344 | 2/1993 | Cook | 215/330 |
| 5,197,616 | 3/1993 | Buono | 215/220 |

FOREIGN PATENT DOCUMENTS 607148 12/1934 Germany .

*Primary Examiner*—Allan N. Shoap
*Assistant Examiner*—Robin A. Hylton
*Attorney, Agent, or Firm*—Jean-Marc Zimmerman

[57] ABSTRACT

A cosmetics compact having mechanism for producing an audible sound to indicate when the compact is completely closed, the compact being opened and closed by slidably rotating the cover and the base in relation to one another.

20 Claims, 2 Drawing Sheets

CONTAINER WITH ROTATING MECHANISM FOR PRODUCING AN AUDIBLE CLOSING SOUND

FIELD OF THE INVENTION

This invention relates generally to containers and more particularly to a compact used to hold or store cosmetics, powders, emulsions, creams, or other semi-solid or paste type materials, wherein the compact includes means for producing an audible signal indicating when the compact is completely closed.

BACKGROUND OF THE INVENTION

Containers used to store cosmetics, such as compacts, are well known in the prior art. Some compacts are airtight to prevent dry, powdery cosmetic material from absorbing moisture from the air, or conversely, to prevent supermoisturized cosmetic material from losing moisture to the air. Compacts having airtight closures are well known in the prior art. See U.S. Pat. Nos. 4,454,889 and 5,186,318.

Closure means which produce an audible sound such as a click to indicate when a container is completely closed are also well known in the prior art. See U.S. Pat. Nos. 5,186,344 and 5,197,616. These audible closure means are more often used in connection with containers for medications, including child-proof containers, than in connection with containers for cosmetics.

Conventional cosmetic containers suffer from several drawbacks. A commonly encountered problem is that if the compact is not properly closed, then when the compact is placed in a jacket pocket or, as is more often the case, in a pocketbook, a portion of the cosmetic material can unintentionally fly out from the compact thereby wasting this material and possibly staining and thus damaging any surfaces upon which the material lands. Another problem commonly encountered with conventional cosmetic compacts is that a significant amount of force must be applied to open the compact which can result in injuries to the person opening the container such as broken nails and/or abrasions. In addition, the application of this force can result in some of the stored material unintentionally flying out of the container with the aforementioned undesired consequences. A final disadvantage encountered with certain conventional cosmetic compacts is that if the cover and the base are not attached to one another, the cover can often be misplaced, or if the cover and the base are attached to one another, the attachment is relatively weak so that repeated opening and closing of the container results in a weakening and eventual breaking of the attachment.

It is, therefore, an object of this invention to provide a compact which includes means for producing an audible signal to indicate when the compact is completely closed. It is also an object of this invention to provide a compact having a cover and base which are attached to one another and which can be opened and closed without the application of a significant amount of force by slidably rotating the cover about the base.

SUMMARY OF THE INVENTION

A cosmetics compact which includes means for producing an audible signal to indicate when the compact is completely closed.

DETAILED DESCRIPTION OF THE DRAWINGS

Figure 1:
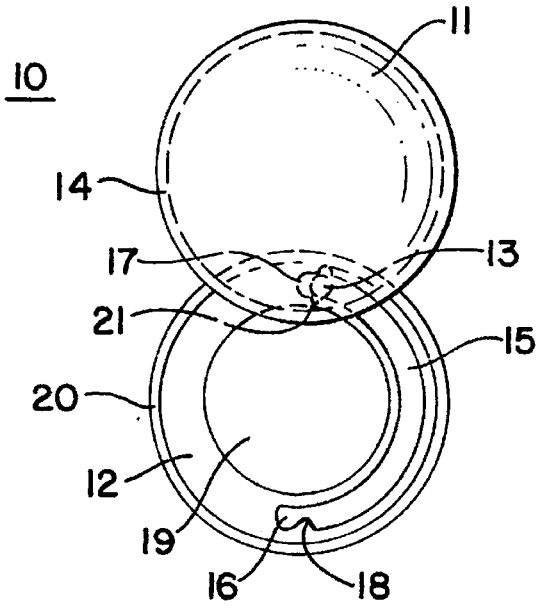
FIG. 1 shows a top plan view of an exemplary embodiment of the compact according to this invention when the compact is open.

Referring to FIG. 1 there is shown a top plan view of compact 10 according to this invention. Compact 10 is comprised of cover 11 and base 12. Cover 11 includes pin 13 which protrudes perpendicularly downwards from cover 11. Cover 11 also includes first thread 14 which extend around the exterior of the lower portion of cover 11.

Base 12 includes slot 15 having first end 16 and second end 17. Flexible, resilient notch 18 protrudes into slot 15 near first end 16. Base 12 also includes reservoir 19 for holding or storing cosmetic material and second thread 20 which extend around the exterior of the upper portion of base 12. Thread 14 and thread 20 engage and disengage from one another. Cover 11 and base 12 are coupled together by means of pin 13 which is permanently positioned in slot 15 and can not be removed from slot 15. Pin 13 can have flanges 21 which ride along and underneath slot 15. Pin 13 can move along slot 15 between first end 16 and second end 17. The positions of pin 13 and slot 15 can be reversed so that pin 13 protrudes from base 12 and slot 15 is positioned in cover 11.

Compact 10 is opened by applying pressure to slidably rotate cover 11 in a counterclockwise direction about and away from base 12. When compact 10 is being opened, pin 13 slides from first end 16 towards second end 17 while thread 14 and thread 20 are loosened from one another causing cover 11 to be raised upwards in relation to base 12. Compact 10 is closed by applying pressure to slidably rotate cover 11 in a clockwise direction about and towards base 12. Compact 10 can be configured so that rotation of cover 11 about base 12 is in the clockwise direction to open compact 10 and in the counterclockwise direction to close compact 10.

When compact 10 is being closed, pin 13 slides from second end 17 towards first end 16 while thread 14 and thread 20 are tightened together causing cover 11 to be lowered downwards in relation to base 12. When compact 10 is being closed, and as pin 13 arrives at first end 16, pin 13 frictionally engages flexible resilient notch 18 thereby producing an audible click indicating that compact 10 is completely closed. Slot 15 permits cover 11 to be rotated about base 12 anywhere from one (1) to two hundred and fifty eight (258) degrees.

Figure 2:
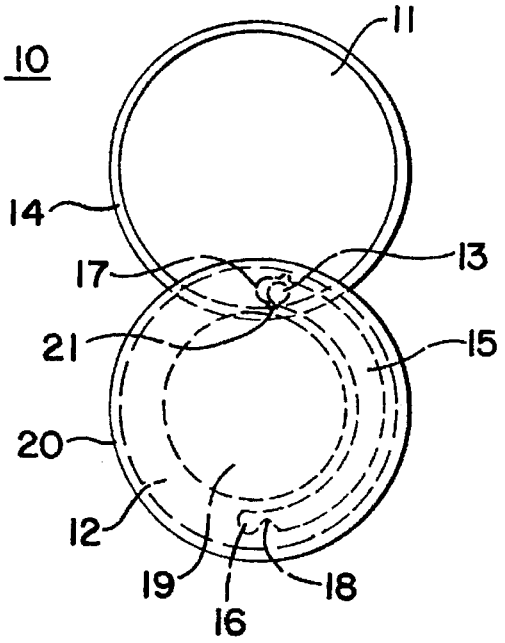
FIG. 2 shows a bottom plan view of the compact shown in FIG. 1.
Figure 3:
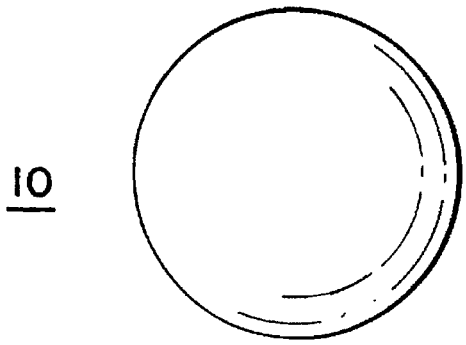
FIG. 3 shows a top plan view of the compact shown in FIG. 1 when the compact is closed.
Figure 4:
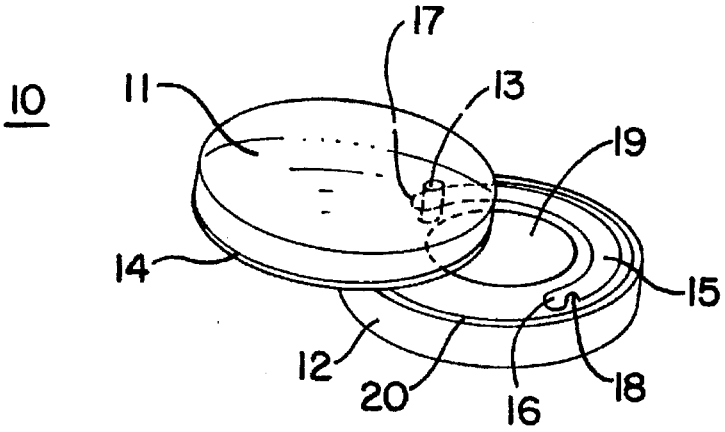
FIG. 4 shows a right side view of the compact shown in FIG. 1 when the compact is open.
Figure 5:
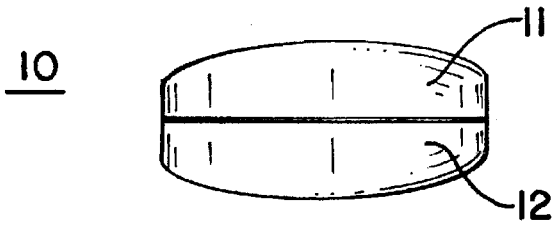
FIG. 5 shows a right side view of the compact shown in FIG. 1 when the compact is closed.

FIG. 2 shows a bottom plan view of compact 10 with cover 11 open. FIG. 3 shows a top plan view of compact 10 with cover 11 closed. FIG, 4 shows a right side view of compact 10 with cover 11 open. FIG, 5 shows a right side view of compact 10 with cover 11 closed.

Compact 10 need not be circularly shaped. Compact 10 can be fabricated in any desired shape or size and from any material. It will be understood that the embodiment described herein is merely exemplary and that a person skilled in the art may make many variations and modifications to the described embodiment utilizing functionally equivalent elements to those described. Any variations or modifications to the invention just described are intended to be included within the scope of said invention as defined by the appended claims.

What is claimed is:

1. A container comprising:

a cover having a member extending perpendicularly from said cover;

a base having a slot, said slot including a flexible resilient object protruding axially therein, said cover being coupled to said base by means of said member being permanently positioned in said slot; and means for producing an audible signal indicating complete closure of said container, said means being comprised of said member and said flexible resilient object, said signal being produced by frictional engagement between said member and said flexible resilient object.

2. The container according to claim 1, wherein said container is opened by rotatably sliding said cover about and away from said base.

3. The container according to claim 1, wherein said container is closed by rotatably sliding said cover about and towards said base.

4. The container according to claim 1, wherein said slot includes a first end and a second end, said member able to slide between said first end and said second end, said member moving towards said first end when said container is closed, and said member moving towards said second end when said container is opened.

5. The container according to claim 1, wherein said cover includes a first thread and said base includes a second thread, said first and said second threads engaging one another, wherein when said container is opened said first and said second threads are loosened in relation to one another, and when said container is closed said first and said second threads are tightened in relation to one another.

6. The container according to claim 1, wherein said container is airtight.

7. The container according to claim 1, wherein said slot enables movement of said cover about said base from between 0° to 258° C.

8. The container according to claim 1, wherein said container is a compact used to store or hold cosmetics.

9. The container according to claim 1, wherein said audible signal is a click.

10. A container comprising:

a cover having a member extending perpendicularly from said cover; and a base including a slot having a first end and a second end, said first end including a flexible resilient object protruding axially into said slot, said cover and said base being attached by means of said member being permanently positioned in said slot, wherein when said container is opened said member moves from said first end towards said second end, and when said container is closed said member moves from said second end towards said first end, wherein frictional engagement between said member and said flexible resilient object produces an audible signal indicating complete closure of said container.

11. The container according to claim 10, wherein said container is opened by rotatably sliding said cover counterclockwise in relation to said base and said container is closed by rotatably sliding said cover clockwise in relation to said base, whereby when said container is closed said cover is aligned directly above said base and when said container is open said cover is offset from and is no longer aligned directly above said base.

12. The container according to claim 10, wherein said container is opened by rotatably sliding said cover clockwise in relation to said base and said container is closed by rotatably sliding said cover counterclockwise in relation to said base, whereby when said container is closed said cover is aligned directly above said base and when said container is open said cover is offset from and is no longer aligned directly above said base.

13. The container according to claim 10, wherein said cover includes a first thread and said base includes a second thread, said first and said second threads engaging one another, wherein when said container is opened said first and said second threads are loosened in relation to one another, and when said container is closed said first and said second threads are tightened in relation to one another.

14. The container according to claim 10, wherein said container is airtight.

15. The container according to claim 1, wherein said slot enables movement of said cover about said base from between 0° to 258°.

16. The container according to claim 10, wherein said container is a compact used to store or hold cosmetics.

17. The container according to claim 10, wherein said member is a pin and said flexible resilient object is a notch.

18. The container according to claim 10, wherein said audible signal is a click.

19. A compact for cosmetics comprising:

a cover having a pin extending perpendicularly downwards from said cover, said cover having a first thread; and a base including a slot having a first end and a second end, said first end including a flexible resilient notch protruding axially into said slot, said cover and said base being attached by means of said pin being permanently positioned in said slot, said base having a second thread, said first and said second threads engaging one another when said compact is closed and disengaging from one another when said compact is opened, said compact being opened by rotatably sliding said cover about and away from said base and said compact being closed by rotatably sliding said cover about and towards said base, whereby when said compact is closed said cover is aligned directly above said base and when said compact is open said cover is offset from and is no longer aligned directly above said base, wherein when said compact is opened said pin moves from said first end towards said second end, and when said compact is closed said pin moves from said second end towards said first end, wherein frictional engagement between said pin and said flexible resilient notch produces an audible click indicating complete closure of said compact.

20. The compact according to claim 19, wherein said compact is airtight.

* * * * *